US009702648B1

(12) United States Patent
Pollack

(10) Patent No.: US 9,702,648 B1
(45) **Date of Patent: *Jul. 11, 2017**

(54) BOLT ACTION CONVERSION KITS AND METHODS

(71) Applicant: Chris Pollack, Carmel, NY (US)

(72) Inventor: Chris Pollack, Carmel, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/063,213

(22) Filed: Mar. 7, 2016

Related U.S. Application Data

(63) Continuation of application No. 14/216,571, filed on Mar. 17, 2014, now Pat. No. 9,279,628.

(60) Provisional application No. 61/802,198, filed on Mar. 15, 2013.

(51) Int. Cl.

| | |
|---|---|
| ***F41A 11/02*** | (2006.01) |
| ***F41A 3/16*** | (2006.01) |
| ***F41A 35/06*** | (2006.01) |
| ***F41A 5/18*** | (2006.01) |
| ***F41A 3/72*** | (2006.01) |

(52) U.S. Cl.
CPC ..... *F41A 11/02* (2013.01); *F41A 3/16* (2013.01); *F41A 3/72* (2013.01); *F41A 5/18* (2013.01); *F41A 35/06* (2013.01)

(58) Field of Classification Search
CPC ..... F41A 3/42; F41A 3/72; F41A 7/02; F41A 11/00; F41A 11/02; F41A 19/33; F41A 19/46; F41A 35/00; F41A 3/12; F41A 3/14; F41A 3/16; F41A 3/18; F41A 3/20; F41A 3/22; F41A 3/24; F41A 5/18; F41A 35/06
USPC ..... 89/128, 1.4, 33.01
See application file for complete search history.

(56) References Cited

U.S. PATENT DOCUMENTS

| | | | | |
|---|---|---|---|---|
| 875,209 | A | 12/1907 | Prinke | |
| 5,606,825 | A | 3/1997 | Olsen | |
| 6,508,158 | B2 | 1/2003 | Murello | |
| 8,176,827 | B2 | 5/2012 | Emde | |
| 8,464,453 | B1 | 6/2013 | Ubl et al. | |
| 9,279,628 | B1 * | 3/2016 | Pollack | F41A 3/12 |
| 2003/0066226 | A1 | 4/2003 | Martin | |
| 2010/0000396 | A1 | 1/2010 | Brown | |
| 2010/0257768 | A1 | 10/2010 | Barrett | |
| 2011/0061523 | A1 | 3/2011 | Webb | |
| 2011/0094136 | A1 | 4/2011 | Zimmerman | |
| 2011/0168009 | A1 | 7/2011 | Robb et al. | |
| 2011/0271827 | A1 | 11/2011 | Larson et al. | |
| 2012/0174451 | A1 | 7/2012 | Overstreet et al. | |
| 2014/0311005 | A1 | 10/2014 | Tertin et al. | |

OTHER PUBLICATIONS

USPTO's Notice of Allowance & Allowability in related U.S. Appl. No. 14/216,571, Dec. 4, 2015.

(Continued)

*Primary Examiner* — Bret Hayes
(74) *Attorney, Agent, or Firm* — Crawford Maunu PLLC

(57) ABSTRACT

The present disclosure relates to kits and associated methods for converting a semi-automatic firearm into a bolt single action firearm, as well as the converted firearm itself. The kit includes a housing (e.g. upper receiver) that accommodates a bolt carrier and a charging handle and a carrier key, if desired. The housing has ends which mount to the existing lower receiver of the semi-automatic firearm to convert the semi-automatic firearm into a manual bolt-action firearm.

5 Claims, 7 Drawing Sheets

(56) References Cited

OTHER PUBLICATIONS

USPTO's Final Office Action in related U.S. Appl. No. 14/216,571, Jul. 16, 2015.
USPTO's Non-Final Office Action in related U.S. Appl. No. 14/216,571, Jan. 22, 2015.

* cited by examiner

A Typical semi automatic AR-15 upper receiver assembly

Charging Handle Operation for initial manual load

Gas Flow for Automatic Bolt Cycling

SECTION D-D
SCALE 1:1
Upper Receiver
Gas Tube
Bolt Carrier

DETAIL E
SCALE 2:1.5
Gas Block
Gas Tube
DETAIL L
SCALE 2:1.5

Upper receiver assembly with the BR-15 conversion kit installed

Charging Handle Operation for manual loading
Gas port is blocked

SECTION B-B
SCALE 1 : 1.5
Upper Receiver
Carrier Key
Bolt Carrier
DETAIL C
SCALE 2 : 1.5

Charging Handle
Eye Center
Upper Receiver
Handguard
Gas Tube
Barrel
Gas Block
Flash Suppressor
5b
5c A typical semi automatic AR-15 upper receiver assembly exploded view Upper receiver assembly exploded view with the BR-15 conversion kit installed A Typical AR-15 Upper Receiver Right hand charging handle slot
Standard AR thread mount accepts any AR specific barrel nut.
Standard mounting points for compatability with any AR specified lower receiver.

Optional left hand charging handle slot for left handed shooters.

BR-15 Upper Receiver

BOLT ACTION CONVERSION KITS AND METHODS

CROSS-REFERENCE TO RELATED APPLICATIONS

This application claims the benefit of priority to and is a continuation of U.S. patent application Ser. No. 14/216,571, filed Mar. 17, 2014, and issued as U.S. Pat. No. 9,279,628, issued Mar. 8, 2016, which in turn claims the benefit of priority to U.S. Provisional Patent Application 61/802,198 filed on Mar. 15, 2013, the disclosure of which is incorporated herein by reference in its entirety for any purpose whatsoever.

BACKGROUND

Field

The disclosed embodiments relate to firearms.

Description of Related Art

For firearm shooters, precision is paramount. Conventional semi-automatic rifles are not precise firearms even with a shooter having superior aim. When using the AR rifle as a semi-automatic firearm, the bolt begins cycle loading the next round prior to the bullet having fully left the barrel. This can cause unintended movement in a shooter's position which affects the aim of the shooter and ultimately the shooter's precision for a target. Moreover, quite commonly when shooting a semi-automatic firearm, it is a natural reaction to shoot more rounds than necessary because of the simplicity of having to just pull the trigger. The present application addresses these and other problems, as described herein.

SUMMARY

Advantages of the present disclosure will be set forth in and become apparent from the description that follows. Additional advantages of the disclosure will be realized and attained by the methods and systems particularly pointed out in the written description and claims hereof, as well as from the appended drawings.

Thus, in one embodiment, the disclosure provides a kit for converting a semi-automatic firearm into a bolt single action firearm. The kit includes a bolt action upper receiver, a bolt carrier configured to accommodate a single round of ammunition and a charging handle. The bolt action upper receiver is configured to be received by a pre-existing lower receiver of the semi-automatic firearm.

In some implementations, the charging handle can be located on the right-hand side or left-hand side of the firearm after the kit is installed, as desired, to accommodate right-handed or left-handed users. The kit is preferably configured to retain the use of original barrel components of the semi-automatic firearm. Preferably, the upper receiver does not include a gas port or gas tube.

The disclosure also provides a firearm converted using a kit as described herein. The firearm is preferably configured such that the charging handle from the kit as installed in the firearm is pulled back to load a round of ammunition after the kit is installed. Moreover, the firearm is preferably configured to permit the casing of the ammunition to be withdrawn and ejected when the charging handle is manually reverted back to its starting position. Preferably, a gas port in a barrel of the firearm is plugged as a result of installing the kit.

The disclosure also provides a method of converting a semi-automatic firearm into a bolt-action firearm. The method includes providing a bolt action upper receiver configured to be received by a pre-existing lower receiver of a semi-automatic firearm, a bolt carrier configured to accommodate a single round of ammunition and a charging handle. The method further includes installing the bolt action upper receiver, bolt carrier and the charging handle onto the pre-existing lower receiver of the semi-automatic firearm.

In further implementations, the disclosure provides a method for converting a semi-automatic firearm into a bolt single action firearm. The steps of the method include removing gas charging components of the semi-automatic firearm, removing an existing charging handle of the semi-automatic firearm, plugging a gas port in a barrel of the semi-automatic firearm, and inserting a housing having a bolt carrier, a carrier key and a charging handle to an existing lower receiver of the semi-automatic of the semi-automatic firearm to form a bolt action rifle.

Converting the assault rifle ("AR") platform semi-automatic rifle into a bolt action firearm through a bolt action conversion kit solves the problem of precision of semi-automatic rifles. The first key benefit for this conversion is to increase the accuracy of the rifle. Once the rifle is converted to a bolt action mechanism, movement is unnecessary until the shooter intends to load the next round.

Converting the assault rifle (AR) platform semi-automatic rifle into a bolt action firearm has an additional benefit. Installing the bolt action conversion kit will significantly increase muzzle velocity. Current semi-automatic rifle design uses gas energy emitted from the source of the shot to cycle the bolt assembly. This loss of energy is directly measured in a decrease of muzzle velocity. When muzzle velocity is lost, there is a decrease in the kinetic energy of the projectile which consequently reduces the range and accuracy of the firearm. Since no gas is needed in the operation of a bolt action firearm and no gas is to be expelled from the barrel for reloading purposes of a bolt action firearm, utilizing the beam rifle (BR-15) conversion kit will ensure the gun will retain and utilize all possible energy in the projectile. This increases the range and accuracy of the firearm.

Moreover, many regions and states are now regulating the ownership of semi-automatic firearms. By providing a conversion kit and related methods, the present application thus helps address the legal issues surrounding ownership of a semi-automatic firearm by converting a semi-automatic firearm into a bolt action firearm.

Quite commonly when shooting a semi-automatic firearm, it is a natural reaction to shoot more rounds than necessary because of the simplicity of having to just pull the trigger. The present application solves this problem since an additional benefit in the installation of the conversion kit is a potential reduction in shooting cost. With a converted bolt action firearm, the shooter is required to manually cycle the bolt before each round is fired by using the charging handle. When manually using a bolt action firearm, a person shooting tends to be more deliberate in their intentions given the additional time spent manually cycling each shot. Less rounds of ammunition fired means less money spent on rounds.

It is to be understood that the foregoing general description and the following detailed description are exemplary and are intended to provide further explanation of the disclosed embodiments. The accompanying drawings, which are incorporated in and constitute part of this specification, are included to illustrate and provide a further understanding of the disclosed methods and systems. Together with the description, the drawings serve to explain principles of the disclosure.

BRIEF DESCRIPTION OF THE FIGURES

FIG. 3, including

FIG. 4, including

FIG. 5, including

FIG. 6, including

FIG. 7, including

FIG. 8, including

DETAILED DESCRIPTION

Figure 1:
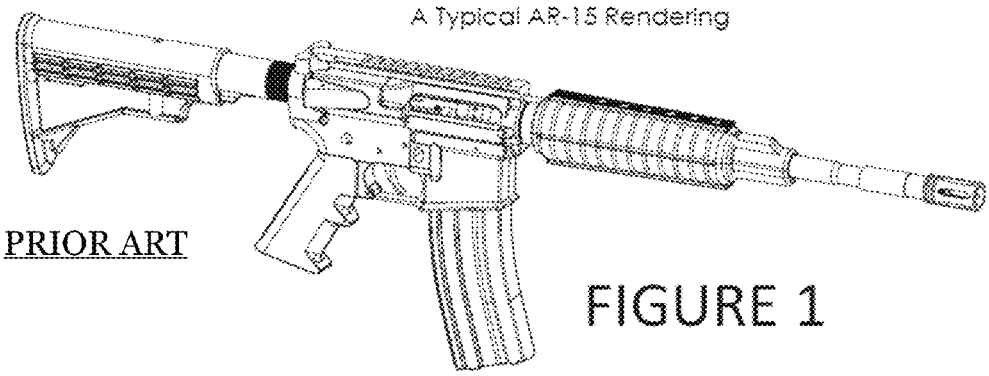
PRIOR ART FIGURE 1
FIG. 1 is an illustrative view of a prior art AR-15 semi-automatic assault rifle.
Figure 2:
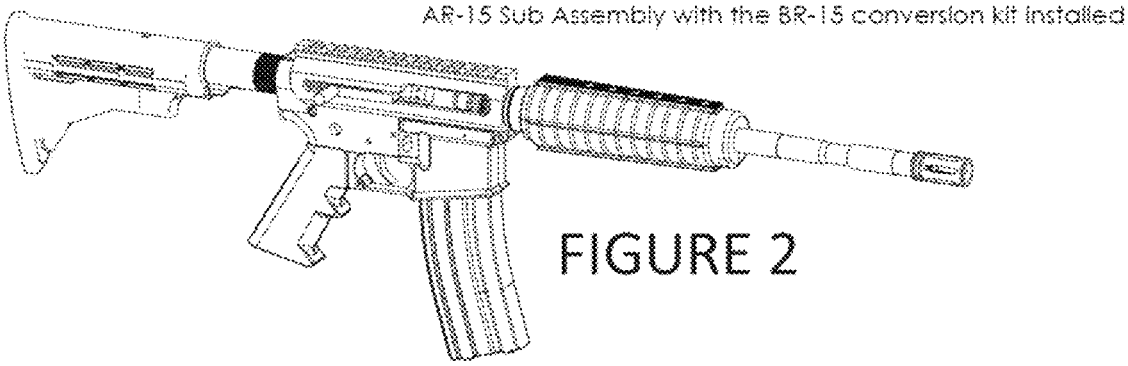
FIG. 2 is an illustrative view of an AR-15 semi-automatic assault rifle with the bolt action conversion kit of the present disclosure installed.

The disclosed embodiments of bolt action conversion kits allow for the converting of a typical semi-automatic assault rifle (AR-15) model (as shown in FIG. 1), Military Model 16 (M16), AR-10, Military Model 4 (MP4) or similar firearm to a bolt action rifle. FIG. 2 shows an example of an assault rifle once the conversion is complete. Once the conversion is complete, the rifle will only be usable as a bolt action rifle and no longer have the ability of auto loading its bullet cartridges. The design is based around the existing dimensions of the assault rifle platform and can install without any modification to the lower receiver assembly. However, in other embodiments, the conversion kit can be used to convert other semi-automatic weapons into bolt action single fire weapons.

Figures 3A, 3B, 3C, 3D, 3E:
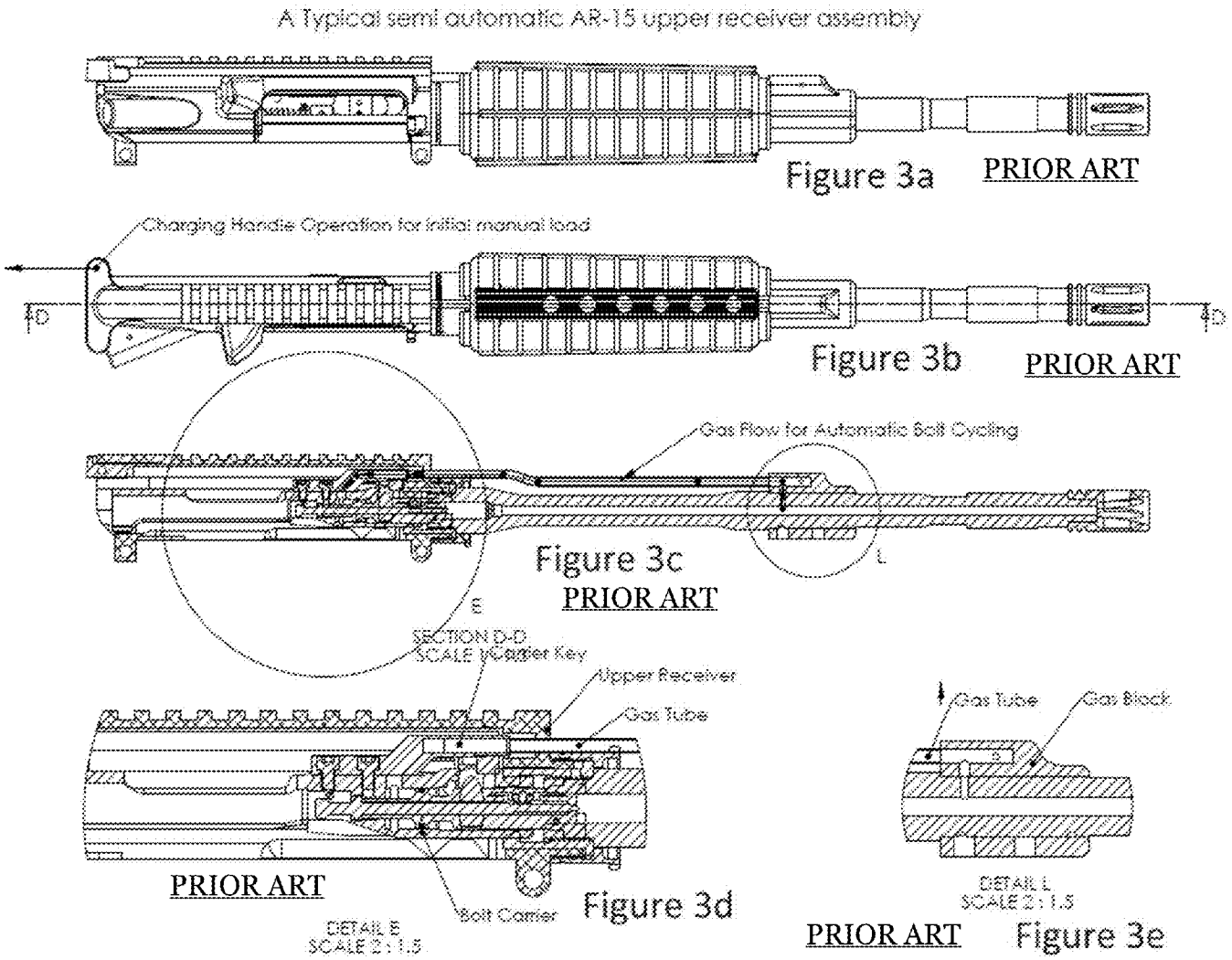
Figure 3a PRIOR ART
Figure 3b PRIOR ART
Figure 3c PRIOR ART
Figure 3d PRIOR ART
Figure 3e PRIOR ART
FIGS. 3*a*-3*e* are illustrative views of the upper receiver assembly of the prior art semi-automatic assault rifle of FIG. 1.

FIG. 3*a* illustrates a side view of a typical semi-automatic assault rifle (AR-15) upper receiver assembly. As shown in FIG. 3*b*, the existing upper receiver assembly of the AR-15 includes a charging handle which allows for an initial manual loading of ammunition. The charging handle allows a shooter to pull the bolt to the rear. The upper receiver assembly includes the main components needed to fire ammunition. FIG. 3*c* illustrates the gas flow needed for the automatic bolt cycling of the weapon. Gas is tapped from the barrel as the bullet moves past a gas port (designated as L in FIG. 3*c*) located above the rifle's front sight base. The gas flows into the port and down a gas tube (as shown in FIG. 3E), located above the barrel, which runs from the front sight base into the AR-15's upper receiver. Here, the gas tube protrudes into the carrier key (as shown in FIG. 3D) which accepts the gas and funnels it into the bolt carrier. The bolt carrier cycles back and forward between each shot. The bolt is propelled back by recoil or expanding gas and propelled forward by the recoil spring.

The bolt recoil causes movement in the shooter which decreases a shooter's accuracy and precision. When the bolt moves back, the extractor, an integral part of the bolt, pulls the spent casing from the chamber. When it moves forward, it strips a cartridge from the magazine and pushes it into the chamber. Once the case is clear of the chamber, the ejector kicks the case out of the weapon. As an example, in firing ten rounds from a semi-automatic firearm, the action would initially be cycled to load the first round and the trigger would need to be pulled ten times (once for each round fired). Semi-automatic weapons cause a shooter to fire multiple rounds unintentionally, thereby wasting ammunition. With installation of the bolt action conversion kit, ammunition is conserved.

Figures 4A, 4B, 4C, 4D:
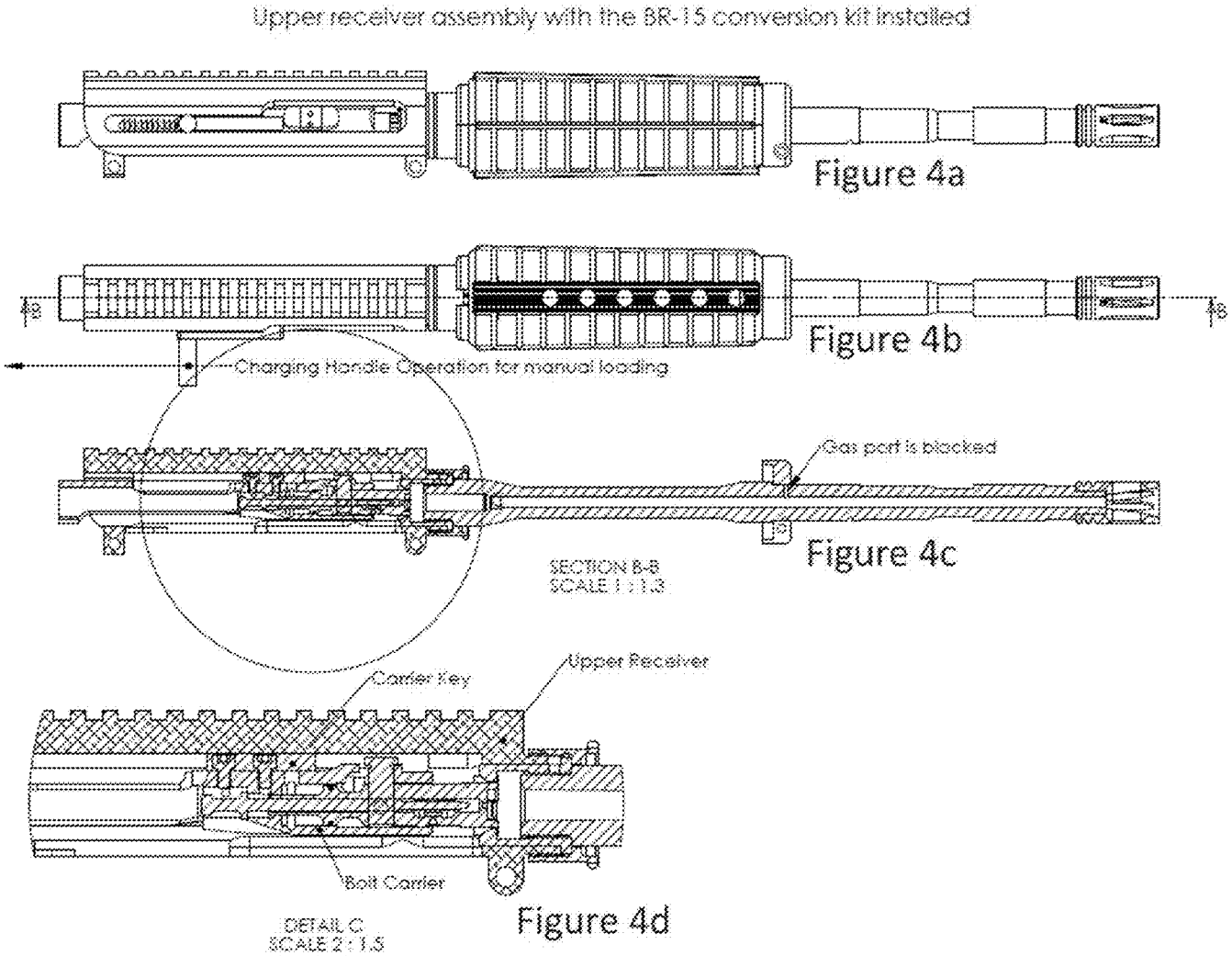
FIGS. 4*a*-4*d* are illustrative views of the upper receiver assembly of a semi-automatic assault rifle with the bolt action conversion kit of the present disclosure installed.

FIG. 4*a* shows a side view of a semi-automatic assault rifle upper receiver assembly with the bolt action conversion kit installed. FIG. 4*b* shows the top view of the upper receiver assembly with the bolt action conversion kit which includes a new charging handle being attached for manual loading of ammunition. Since installation of the bolt action conversion kit utilizes the existing barrel assembly of the semi-automatic weapon, the conversion begins with the gas charging components of the semi-automatic weapon being removed as they are no longer needed. This includes plugging or blocking the gas port in the barrel as shown in FIG. 4*c*. FIG. 4*d* shows the new designed carrier key, bolt carrier and upper receiver.

Figures 5A, 5B, 5C:
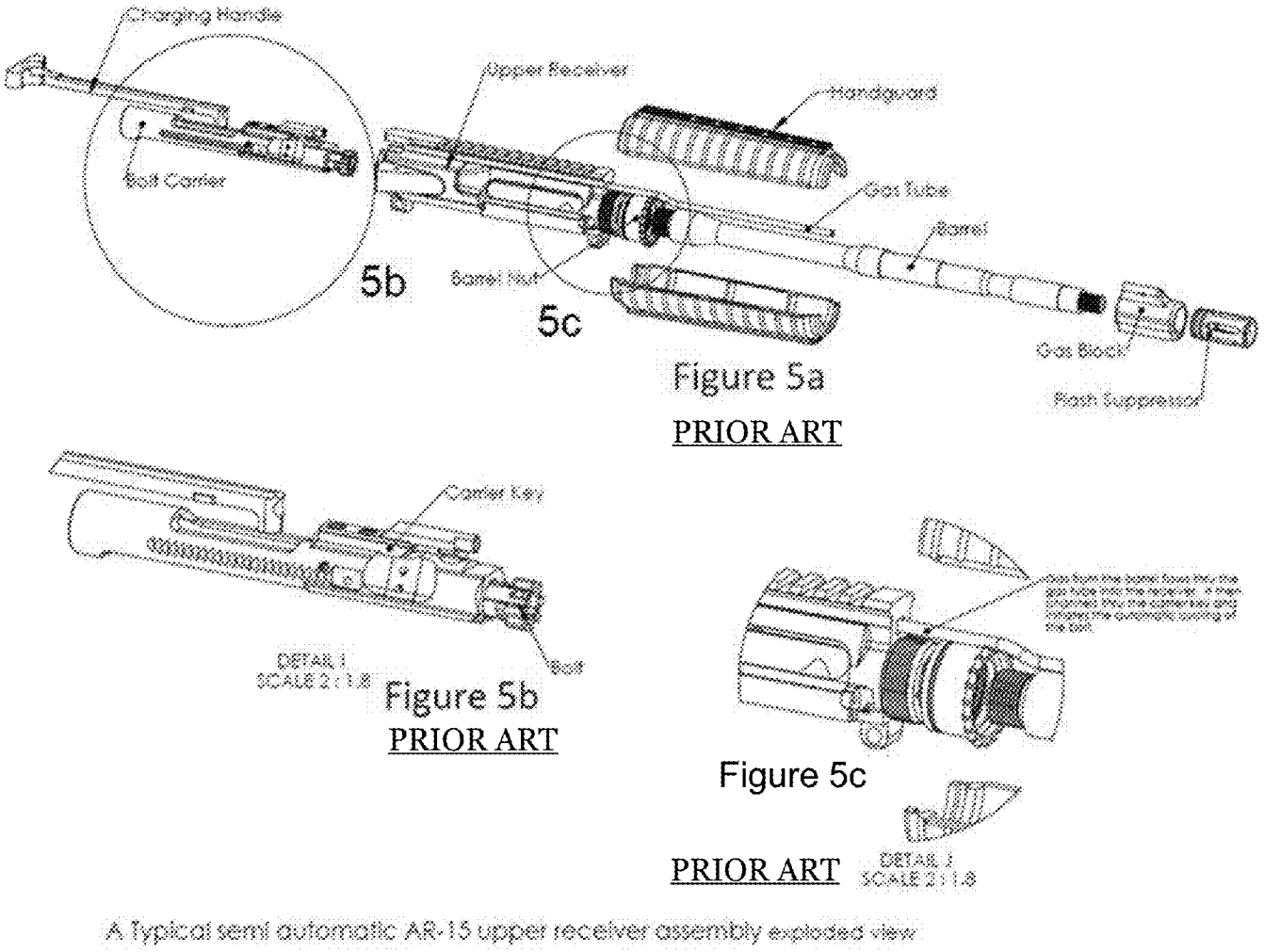
Figure 5a PRIOR ART
Figure 5b PRIOR ART
Figure 5c PRIOR ART
FIGS. 5*a*-5*c* are illustrative exploded views of the upper receiver assembly of the prior art semi-automatic assault rifle of FIG. 1.

FIG. 5 shows a typical semi-automatic assault rifle (AR-15) upper receiver assembly parts in an exploded view. As described above, in FIG. 5*a*, gas from the barrel flows through the gas tube into the receiver. Gas is tapped from the barrel as the bullet moves past the gas port. The gas flows into the gas port and down the gas tube, located above the barrel, which runs from the front sight base into the AR-15's upper receiver. The gas tube protrudes into the carrier key (as shown in FIG. 5*b*) which accepts the gas and funnels it into the bolt carrier. This initiates the automatic cycling of the bolt carrier. The bolt carrier cycles back and forward between each shot. The bolt is propelled back by recoil or expanding gas and propelled forward by the recoil spring. The barrel nut, as shown in FIG. 5*a*, connects the upper receiver to the barrel of the assault rifle.

Figure 6A:
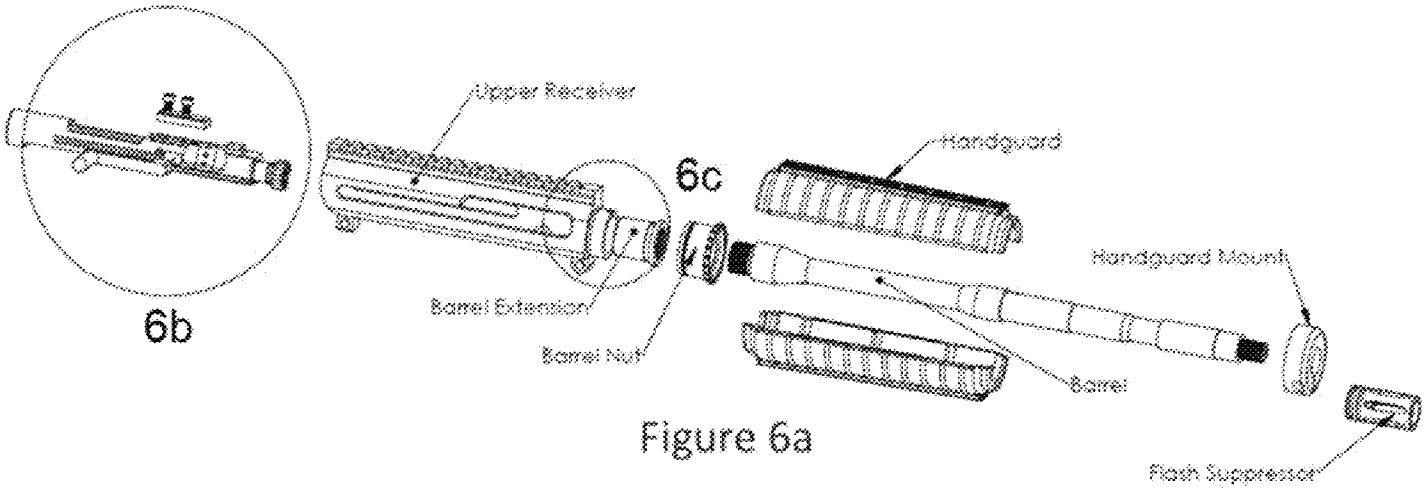
FIGS. 6*a*-6*c* are illustrative exploded views of the upper receiver assembly of a semi-automatic assault rifle with the bolt action conversion kit of the present disclosure installed.
Figure 6B:
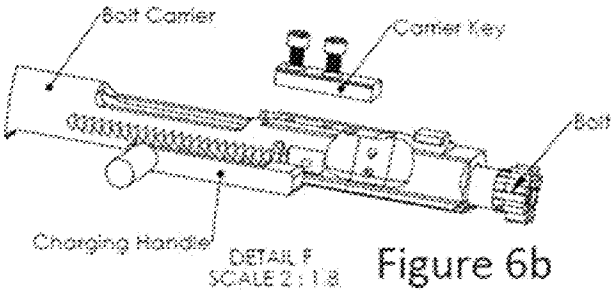
Figure 6C:
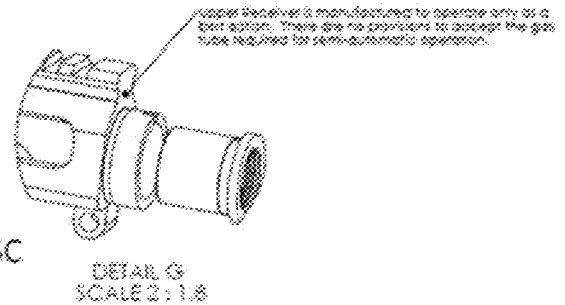

The conversion kit transforms such a semi-automatic weapon as discussed above into a bolt action or single action firearm. As shown in FIG. 6*a*, the gas tube and gas block are removed from the semi-automatic weapon as they are no longer needed. The existing gas port is blocked. As shown in FIG. 6*b*, the conversion kit assembly components include but are not limited to a bolt action upper receiver, bolt carrier and charging handle. The upper receiver is then inserted onto the existing lower receiver and retains the use of the original barrel components (as shown in FIG. 6*a*). However, the new charging handle is located on the right-hand side of the weapon where it is often located in bolt action firearms. The charging handle is then pulled back and moved forward, which loads the round. When the round is fired, the casing is withdrawn and ejected when the charging handle is manually reverted back to its starting position. In additional implementations, the bolt action conversion kit is configured to convert other semi-automatic weapons into bolt action weapons.

Figure 7A:
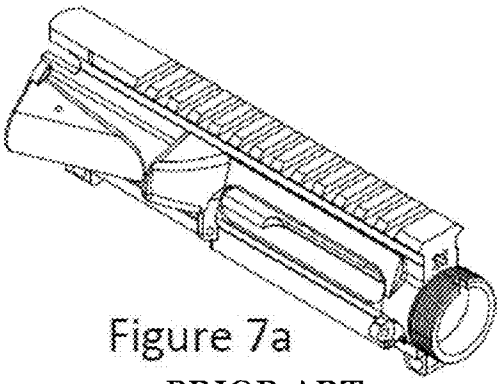
Figure 7a PRIOR ART
FIGS. 7*a*-7*f* are illustrative alternative views of the upper receiver of the prior art semi-automatic assault rifle of FIG. 1.
Figure 7B:
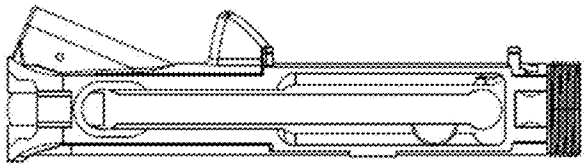
Figure 7b PRIOR ART
Figure 7D:
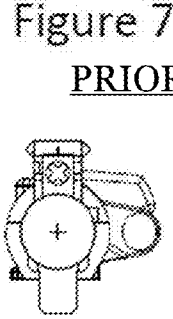
Figure 7d PRIOR ART
Figure 7E:
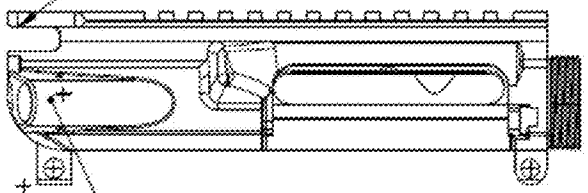
Figure 7e PRIOR ART
Figure 7F:
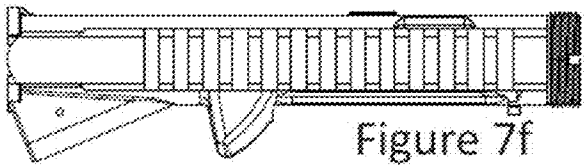
Figure 7f PRIOR ART
Figure 7C:
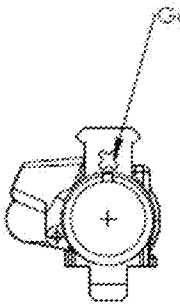
Figure 7c PRIOR ART
Figures 8A, 8B, 8C, 8D, 8E, 8F, 8G:
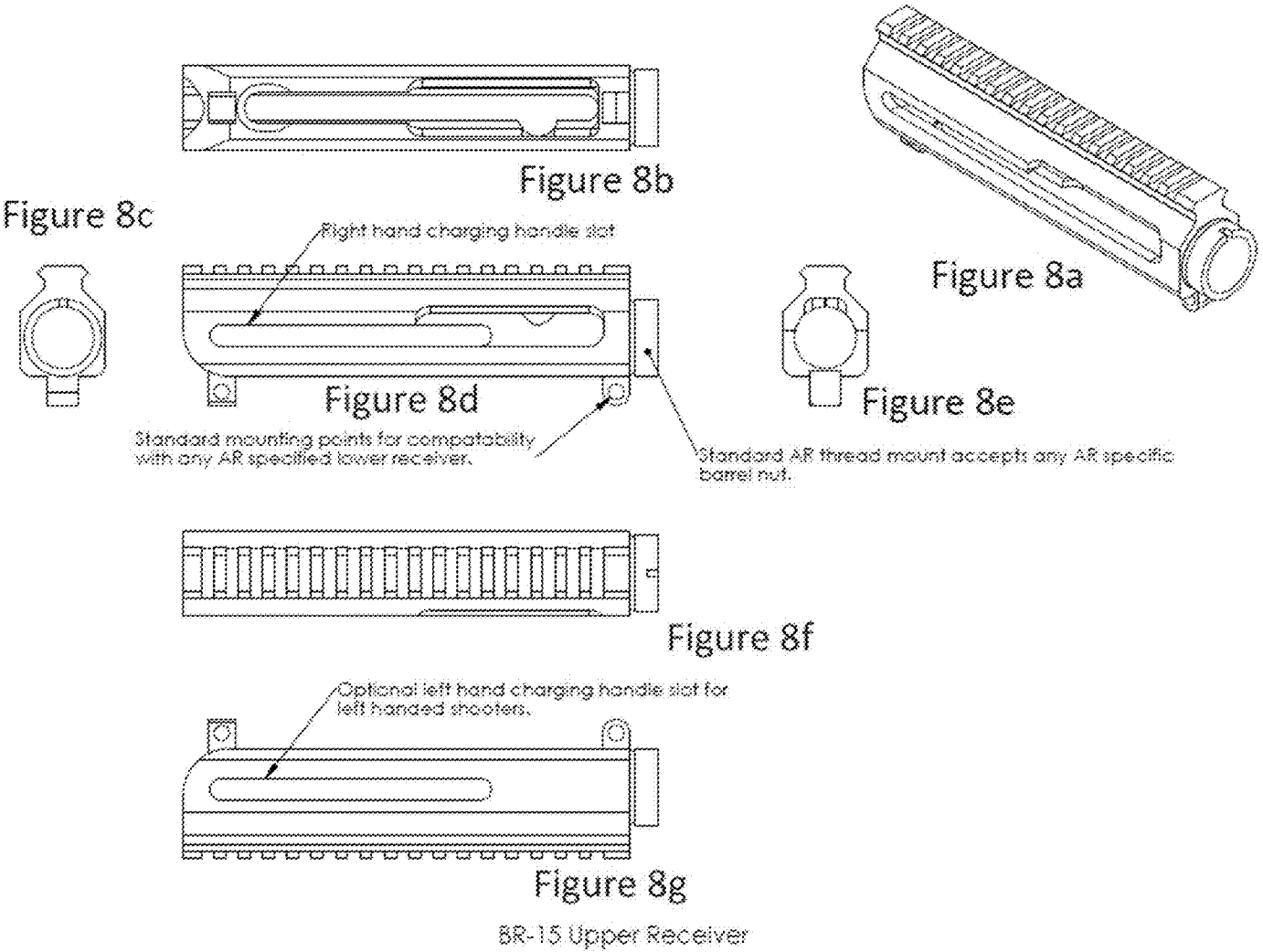
FIGS. 8*a*-8*g* are illustrative exploded views of the upper receiver of a semi-automatic assault rifle with the bolt action conversion kit of the present disclosure installed.

For further illustration, FIG. 7*a*-7*f* shows an alternative view of the upper receiver of a typical semi-automatic assault rifle. FIG. 7*c* shows a top view of the gas tube port which is an unnecessary component once the bolt action conversion kit is installed. FIG. 7*d* shows the bottom view of the gas port tube. In addition, the charging handle slot and forward assist port, as shown in FIG. 7*d*, are also unnecessary components once the conversion kit is installed. FIG. 8*a*-8*g* illustrates an alternative view of the upper receiver of the bolt action conversion kit. FIG. 8*c* and FIG. 8*e* show the upper receiver without the gas tube port. FIG. 8*d* shows the slot where the right-hand charging handle is inserted. The upper receiver of the conversion kit also includes standard mounting points where the existing lower receiver of the semi-automatic assault rifle can be attached to. Similarly, FIG. 8*d* shows the standard assault rifle thread mount which accommodates any assault rifle specific barrel nut which connects to the barrel of the assault rifle. In another embodiment, as shown in FIG. 8*g*, the upper receiver of the bolt action conversion kit includes a slot for a left-hand charging handle slot to be inserted for the benefit of left-handed shooters.

Various other components may be included and called upon for providing for aspects of the teachings herein. For example, additional materials, combinations of materials and/or omission of materials may be used to provide for added embodiments that are within the scope of the teachings herein. In the present application a variety of variables are described, including but not limited to components and conditions. It is to be understood that any combination of any of these variables can define an embodiment of the disclosure. Other combinations of articles, components, conditions, and/or methods can also be specifically selected from among variables listed herein to define other embodiments, as would be apparent to those of ordinary skill in the art.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

While the disclosure refers to exemplary embodiments, it will be understood by those skilled in the art that various changes may be made and equivalents may be substituted for elements thereof without departing from the scope of the disclosure. In addition, many modifications will be appreciated by those skilled in the art to adapt a particular instrument, situation or material to the teachings of the disclosure without departing from the spirit thereof. Therefore, it is intended that the disclosure not be limited to the particular embodiments disclosed.

What is claimed is:

1. A kit for converting a semi-automatic firearm into a bolt single action firearm, the kit comprising:

a) a modified bolt action upper receiver configured to be received by a pre-existing lower receiver of the semi-automatic firearm, the modified bolt action upper receiver having a proximal end, a distal end, a right side portion, a left side portion and an elongate upper wall section between the proximal end and distal end, wherein the modified bolt action upper receiver includes a right side charging handle slot defined through the right side portion, a left side charging handle slot extending through the left side portion, and an ejection port, the ejection port intersecting with the right side charging handle slot to form a common opening through the right side portion;

b) a modified bolt carrier configured to accommodate a single round of ammunition configured to reside within the modified bolt action upper receiver, the modified bolt carrier including two lateral sides that project toward the left side charging handle slot and the right side charging handle slot; and c) a reconfigurable charging handle configured to attach to either of said lateral sides of the modified bolt carrier and extend through one of the left side and right side charging handle slots, the reconfigurable charging handle including a distal portion configured to be connected to one of the said lateral sides of the modified bolt carrier, an elongate body, and a proximal portion displaced along a length of the firearm proximally from the distal portion of the modified charging handle.

2. A firearm converted from a semi-automatic firearm into a bolt single action firearm using the kit of claim 1.

3. The kit of claim 1, wherein a native gas port in a barrel of the firearm is plugged as a result of installing the kit.

4. The kit of claim 3, wherein the native gas port in the barrel of the firearm is blocked by installing a distal hand guard mount supplied with the kit on the barrel to block the native gas port.

5. The kit of claim 1, wherein each charging handle slot is defined by a complete perimeter including opposing longitudinal top and bottom edges joined by opposing end edges, each charging handle slot intersecting a horizontal plane that is parallel with a geometric centerline of a barrel of the firearm.

* * * * *